US010134345B1

(12) United States Patent
Zha et al.

(10) Patent No.: US 10,134,345 B1
(45) Date of Patent: Nov. 20, 2018

(54) LUMINANCE ADJUSTMENT METHOD FOR RGBW LCD AND APPARATUS THEREOF

(71) Applicant: Wuhan China Star Optoelectronics Technology Co., Ltd., Wuhan (CN)

(72) Inventors: Guowei Zha, Wuhan (CN); Hongqing Cui, Wuhan (CN); Qi Wei, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 48 days.

(21) Appl. No.: 15/534,000

(22) PCT Filed: Apr. 19, 2017

(86) PCT No.: PCT/CN2017/081031

§ 371 (c)(1),
(2) Date: Jun. 8, 2017

(87) PCT Pub. No.: WO2018/176523

PCT Pub. Date: Oct. 4, 2018

(30) Foreign Application Priority Data

Mar. 27, 2017 (CN) ..... 2017 1 0188857

(51) Int. Cl.
*G09G 3/36* (2006.01)
*G09G 3/34* (2006.01)
*G09G 3/20* (2006.01)

(52) U.S. Cl.
CPC ..... *G09G 3/3607* (2013.01); *G09G 3/2003* (2013.01); *G09G 3/3406* (2013.01);
(Continued)

(58) Field of Classification Search
CPC .... G09G 5/02; G09G 5/06; G09G 2320/0666; G09G 2320/0626; G06T 11/001
See application file for complete search history.

(56) References Cited

U.S. PATENT DOCUMENTS 7,688,328 B2 * 3/2010 Chen ..... G09G 5/02 345/589
2017/0330529 A1 * 11/2017 Van Mourik ..... H04N 5/20
(Continued)

FOREIGN PATENT DOCUMENTS

CN 102968943 A 3/2013
CN 104851387 A 8/2015
(Continued)

*Primary Examiner* — Todd Buttram
(74) *Attorney, Agent, or Firm* — Leong C. Lei

(57) ABSTRACT

The invention provides a luminance adjustment method and apparatus for RGBW LCD, which uses first and second EOTFs to generate a grayscale luminance lookup table for RGBW LCD, and makes the grayscale-luminance relation in lookup table corresponding to the first EOTF within the grayscale interval between 0 and grayscale threshold; the grayscale-luminance relation in lookup table corresponding to the second EOTF within the grayscale interval between grayscale threshold and 255; the curve slope of the second EOTF greater than the curve slope of the first EOTF within the interval between second luminance threshold and maximum luminance value. By adopting different EOTFs for low and high grayscale intervals, the method considers the poor dark state characteristics of LCD and characteristics of RGBW LCD having higher maximum luminance, and improves the display capability of RGBW LCD in details of high grayscale images.

13 Claims, 3 Drawing Sheets

(52) U.S. Cl.
CPC ..... *G09G 2300/0452* (2013.01); *G09G 2320/0233* (2013.01); *G09G 2320/0626* (2013.01)

(56) References Cited

U.S. PATENT DOCUMENTS

| | | | | |
|---|---|---|---|---|
| 2018/0122058 | A1* | 5/2018 | Kang | G06T 7/136 |
| 2018/0204528 | A1* | 7/2018 | Miyazawa | G02F 1/133 |

FOREIGN PATENT DOCUMENTS

| | | | |
|---|---|---|---|
| CN | 105632460 | A | 6/2016 |
| CN | 105721844 | A | 6/2016 |
| CN | 105895054 | A | 8/2016 |
| KR | 20130053219 | A | 5/2013 |

* cited by examiner

LUMINANCE ADJUSTMENT METHOD FOR RGBW LCD AND APPARATUS THEREOF

BACKGROUND OF THE INVENTION

1. Field of the Invention

The present invention relates to the field of display, and in particular to a luminance adjustment method for RGBW liquid crystal display (LCD) and apparatus thereof.

2. The Related Arts

As display technology progresses, the liquid crystal display (LCD) shows the advantages of high display quality, low power-consumption, thinness, and wide applications, the LCD is widely used in various devices, such as, liquid crystal TV, mobile phones, PDA, digital camera, PC monitors or notebook PC screens, becomes the leading display technology.

The known LCD generally comprises a plurality of pixels arranged in an array, and each pixel which further comprises a red sub-pixel, a green sub-pixel, and a blue sub-pixel arranged in this order. Because the three-color pixels of the LCD has a lower luminance level, the LCD can still follow the electro-optical characteristics curve used by traditional cathode ray tube (CRT) display; that is, the grayscale and luminance curves follow the gamma curve with gamma value equal to 2.2, i.e., $Lum=Lmax\times(Gray/255)^{2.2}$, where Gray is the grayscale value, Lum is the luminance corresponding to the grayscale value Gray, and Lmax is the maximum luminance of the LCD. Furthermore, the known technology also provides a four-color display with red, green, blue and white (RGBW), which adds a white sub-pixel in a conventional three-color (RGB) display device, and the white sub-pixel is formed by an organic material with high luminance transmittance and can greatly increase the luminance and transmittance levels of the LCD. Specifically, the maximum luminance of the known RGB display is usually 400-500 nits level, while the RGBW display can reach the maximum luminance of 700-1200 nits. Human eyes have different capacities for luminance difference. In the lower luminance interval, the human eye can recognize the very small luminance difference, and in the higher luminance interval, the human eye can only identify the larger luminance. Therefore, for the display device with the higher maximum luminance value, if the electro-optical characteristic curve of the traditional CRT display is followed, the result will affect the luminance recognition capacity for the high luminance area in the human eye and fails to show quality images with high dynamic range (HDR).

To solve the above problems of the prior art, the invention proposes a new electro-optical transfer function (EOTF), which uses 10 bits to coding a maximum luminance of 10000 nits, and is able to display high quality images of HDR. However, since the LCD is a passive light-emitting device, the luminance of the grayscale needs to be controlled by incorporating birefringence effect of the liquid crystal molecules and polarization characteristics of the polarizer, and the birefringence and polarization characteristics of the polarizer tend to be non-ideal, thus, compared to the active light-emitting display, the LCD often fails to perform optimally in the dark state, therefore, the specific operation is unable to fully utilize the characteristics of new EOTF in the low luminance interval. In addition, while the TV products are usually applied in the darker environment, the mobile smart devices are typically used in daily indoor environment and an outdoor environment, which has a larger ambient light, and thus the display of the mobile smart device having grayscale with excessive dark gradation segmentation does not have practical value under the influence of ambient light. Therefore, it is necessary to devise a new luminance adjustment method and apparatus for RGBW LCD, which taking into account the poor dark state characteristics of the LCD and the characteristics of the RGBW LCD having higher maximum luminance value, to improve the display capability of the RGBW LCD in details of high grayscale images.

SUMMARY OF THE INVENTION

The object of the present invention is to provide a luminance adjustment method for RGBW liquid crystal display (LCD), which taking into account the poor dark state characteristics of the LCD and the characteristics of the RGBW LCD having higher maximum luminance value, to improve the display capability of the RGBW LCD in details of high grayscale images.

Another object of the present invention is to provide a luminance adjustment apparatus for RGBW LCD, which taking into account the poor dark state characteristics of the LCD and the characteristics of the RGBW LCD having higher maximum luminance value, to improve the display capability of the RGBW LCD in details of high grayscale images.

To achieve the above object, the present invention provides a luminance adjustment method for RGBW liquid crystal display (LCD), comprising the following steps of:

Step 1: providing a RGBW LCD, obtaining the maximum luminance value, a default first luminance threshold, a default second luminance threshold, and a default gamma value, the default second luminance threshold being greater than the default first luminance threshold;

Step 2: based on the default first luminance threshold, the default gamma value, and a default first electro-optical transfer function (EOTF), computing to obtain a grayscale value corresponding to the first luminance threshold, and defining the grayscale value as a grayscale threshold;

Step 3: based on the maximum luminance value of the RGBW LCD, the grayscale threshold computed in Step 2, the default first EOTF, and a default second EOTF, generating a grayscale luminance lookup table for the RGBW LCD;

within the grayscale interval from 0 grayscale value to the grayscale threshold, the relation between grayscale and luminance in the grayscale luminance lookup table being corresponding to the first EOTF; within the grayscale interval from the grayscale threshold to 255 grayscale, the relation between grayscale and luminance in the grayscale luminance lookup table being corresponding to the second EOTF;

within the interval of the second luminance threshold and the maximum luminance value, the slope of the curve of the second EOTF being greater than the slope of the curve of the first EOTF;

Step 4: based on the grayscale luminance lookup table generated in Step 3, adjusting the luminance of the RGBW LCD.

According to a preferred embodiment of the present invention, the first EOTF is the standard gamma curve function of the default gamma value:

$$Lum=Lmax\times(G/255)^{gamma};$$

wherein G is 8-bit grayscale value, Lum is the luminance corresponding to the grayscale value, Lmax is the maximum luminance value of the RGBW LCD, gamma is the default gamma value.

According to a preferred embodiment of the present invention, the second EOTF is:

$$Lum = 4000 \times \left\{ \frac{\max\left[\left(\frac{grayx}{1024}\right)^{\frac{1}{m2}} - C_{1.0}\right]}{C_2 - C_3 \times \left(\frac{grayx}{1024}\right)^{\frac{1}{m2}}} \right\}^{\frac{1}{m1}};$$

wherein grayx is a 10-bit grayscale value corresponding to the 8-bit grayscale value obtained by using a default grayscale value compression equation, m1=0.159, m2=78.844, C1=0.836, C2=18.85, C3=18.69;

the default grayscale value compression equation is:

$$grayx = \left[(G - Gt) \times \frac{\text{gray2} - \text{gray1}}{255 - Gt}\right] + \text{gray}^1;$$

wherein Gt is the grayscale threshold computed in Step 2, gray1 is a 10-bit grayscale value corresponding to the first luminance threshold computed according to the default first luminance threshold and default 10-bit luminance grayscale transfer equation, gray2 is a 10-bit grayscale value corresponding to the maximum luminance value computed according to the maximum luminance value and the default 10-bit luminance grayscale transfer equation, grayx ranges from gray1 to gray2;

the default 10-bit luminance grayscale transfer equation is:

$$L = 4000 \times \left\{ \frac{\max\left[\left(\frac{\text{gray}}{1024}\right)^{\frac{1}{m2}} - C_{1.0}\right]}{C_2 - C_3 \times \left(\frac{\text{gray}}{1024}\right)^{\frac{1}{m2}}} \right\}^{\frac{1}{m1}};$$

wherein L is a luminance value, gray is a 10-bit grayscale value corresponding to the luminance value.

According to a preferred embodiment of the present invention, the default gamma value ranges from 1.8 to 2.4.

According to a preferred embodiment of the present invention, in Step 3, an interpolation method is used to generate the grayscale luminance lookup table for RGBW LCD.

The present invention also provides a luminance adjustment apparatus for RGBW LCD, comprising: a parameter acquisition module, a grayscale threshold calculation module related to the parameter acquisition module, a lookup table generation module related to the parameter acquisition module and the grayscale threshold calculation module, and a luminance adjustment module related to the lookup table generation module;

the parameter acquisition module being for acquiring the maximum luminance value, a default first luminance threshold, a default second luminance threshold, and a default gamma value of the RGB LCD, the default second luminance threshold being greater than the default first luminance threshold;

the grayscale threshold calculation module being for, based on the default first luminance threshold, the default gamma value, and a default first electro-optical transfer function (EOTF), computing to obtain a grayscale value corresponding to the first luminance threshold, and defining the grayscale value as a grayscale threshold;

the lookup table generation module being for, based on the maximum luminance value of the RGBW LCD, the grayscale threshold, the default first EOTF, and a default second EOTF, generating a grayscale luminance lookup table for the RGBW LCD; within the grayscale interval from 0 grayscale value to the grayscale threshold, the relation between grayscale and luminance in the grayscale luminance lookup table being corresponding to the first EOTF; within the grayscale interval from the grayscale threshold to 255 grayscale, the relation between grayscale and luminance in the grayscale luminance lookup table being corresponding to the second EOTF;

within the interval of the second luminance threshold and the maximum luminance value, the slope of the curve of the second EOTF being greater than the slope of the curve of the first EOTF;

the luminance adjustment module being for, based on the grayscale luminance lookup table generated by the lookup table generation module, adjusting the luminance of the RGBW LCD.

According to a preferred embodiment of the present invention, the first EOTF is the standard gamma curve function of the default gamma value:

$$\text{Lum} = L\text{max} \times (G/255)^{gamma};$$

wherein G is 8-bit grayscale value, Lum is the luminance corresponding to the grayscale value, Lmax is the maximum luminance value of the RGBW LCD, gamma is the default gamma value.

According to a preferred embodiment of the present invention, the second EOTF is:

$$Lum = 4000 \times \left\{ \frac{\max\left[\left(\frac{grayx}{1024}\right)^{\frac{1}{m2}} - C_{1.0}\right]}{C_2 - C_3 \times \left(\frac{grayx}{1024}\right)^{\frac{1}{m2}}} \right\}^{\frac{1}{m1}};$$

wherein grayx is a 10-bit grayscale value corresponding to the 8-bit grayscale value obtained by using a default grayscale value compression equation, m1=0.159, m2=78.844, C1=0.836, C2=18.85, C3=18.69;

the default grayscale value compression equation is:

$$grayx = \left[(G - Gt) \times \frac{\text{gray2} - \text{gray1}}{255 - Gt}\right] + \text{gray}^1;$$

wherein Gt is the grayscale threshold, gray1 is a 10-bit grayscale value corresponding to the first luminance threshold computed according to the default first luminance threshold and default 10-bit luminance grayscale transfer equation, gray2 is a 10-bit grayscale value corresponding to the maximum luminance value computed according to the maximum luminance value and the default 10-bit luminance grayscale transfer equation, grayx ranges from gray1 to gray2;

the default 10-bit luminance grayscale transfer equation is:

$$L = 4000 \times \left\{ \frac{\max\left[\left(\frac{\text{gray}}{1024}\right)^{\frac{1}{m2}} - C_{1.0}\right]}{C_2 - C_3 \times \left(\frac{\text{gray}}{1024}\right)^{\frac{1}{m2}}} \right\}^{\frac{1}{m1}};$$

wherein L is a luminance value, gray is a 10-bit grayscale value corresponding to the luminance value.

According to a preferred embodiment of the present invention, the default gamma value ranges from 1.8 to 2.4.

According to a preferred embodiment of the present invention, the lookup table generation module uses an interpolation method to generate the grayscale luminance lookup table for RGBW LCD.

The present invention also provides a luminance adjustment method for RGBW liquid crystal display (LCD), comprising the following steps of:

Step 1: providing a RGBW LCD, obtaining the maximum luminance value, a default first luminance threshold, a default second luminance threshold, and a default gamma value, the default second luminance threshold being greater than the default first luminance threshold;

Step 2: based on the default first luminance threshold, the default gamma value, and a default first electro-optical transfer function (EOTF), computing to obtain a grayscale value corresponding to the first luminance threshold, and defining the grayscale value as a grayscale threshold;

Step 3: based on the maximum luminance value of the RGBW LCD, the grayscale threshold computed in Step 2, the default first EOTF, and a default second EOTF, generating a grayscale luminance lookup table for the RGBW LCD; within the grayscale interval from 0 grayscale value to the grayscale threshold, the relation between grayscale and luminance in the grayscale luminance lookup table being corresponding to the first EOTF; within the grayscale interval from the grayscale threshold to 255 grayscale, the relation between grayscale and luminance in the grayscale luminance lookup table being corresponding to the second EOTF;

within the interval of the second luminance threshold and the maximum luminance value, the slope of the curve of the second EOTF being greater than the slope of the curve of the first EOTF;

Step 4: based on the grayscale luminance lookup table generated in Step 3, adjusting the luminance of the RGBW LCD;

wherein the default gamma value ranging from 1.8 to 2.4;

wherein an interpolation method being used to generate the grayscale luminance lookup table for RGBW LCD.

Compared to the known techniques, the present invention provides the following advantages: the present invention provides a luminance adjustment method for RGBW LCD, which uses the default first luminance threshold, default gamma value, and default first EOTF to compute the grayscale value corresponding to the first luminance threshold and define the grayscale value as grayscale threshold; and then, based on the maximum luminance value of the RGBW LCD, grayscale threshold, default first EOTF and default second EOTF, generates the grayscale luminance lookup table for RGBW LCD, and make the relation between grayscale and luminance in the grayscale luminance lookup table being corresponding to the first EOTF within the grayscale interval from 0 grayscale value to the grayscale threshold; the relation between grayscale and luminance in the grayscale luminance lookup table being corresponding to the second EOTF within the grayscale interval from the grayscale threshold to 255 grayscale; the slope of the curve of the second EOTF being greater than the slope of the curve of the first EOTF within the interval of the second luminance threshold and the maximum luminance value. By adopting different EOTFs for low grayscale interval and high grayscale interval, the method takes into account the poor dark state characteristics of the LCD and the characteristics of the RGBW LCD having higher maximum luminance value, and improves the display capability of the RGBW LCD in details of high grayscale images. The present invention also provides a luminance adjustment apparatus for RGBW LCD, which taking into account the poor dark state characteristics of the LCD and the characteristics of the RGBW LCD having higher maximum luminance value, to improve the display capability of the RGBW LCD in details of high grayscale images.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 3:
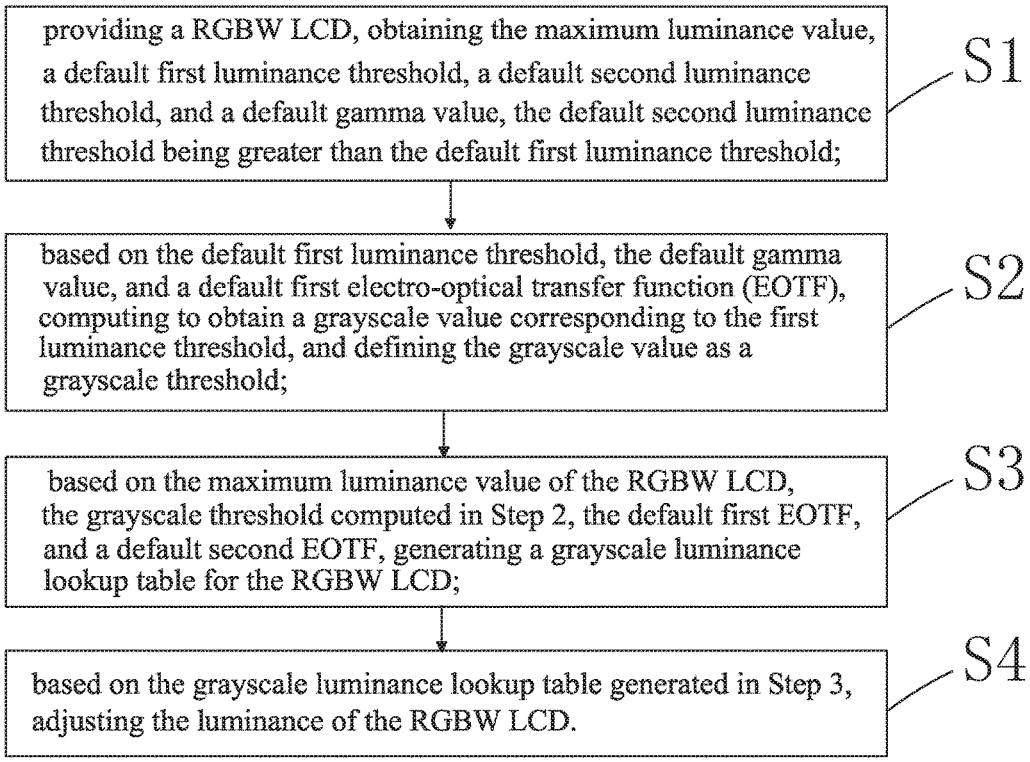
FIG. 3 is a flowchart showing the luminance adjustment method for RGBW LCD according to the present invention.

Refer to FIG. 3. The present invention provides a luminance adjustment method for RGBW liquid crystal display (LCD), comprising the following steps of: Step 1: providing a RGBW LCD, obtaining the maximum luminance value, a default first luminance threshold, a default second luminance threshold, and a default gamma value, the default second luminance threshold being greater than the default first luminance threshold.

Specifically, the default gamma value ranges from 1.8 to 2.4. The first luminance threshold and the second luminance threshold can be selected by considering both the maximum luminance value and actual application. The RGBW LCD uses 8-bit grayscale values, i.e., from 0 grayscale to 255 grayscale.

For example, in an embodiment of the present invention, the maximum luminance value for the provided RGBW LCD is 1000 nits, the default first luminance threshold is 100 nits, the default second luminance threshold is 700 nits, and the default gamma value is 2.2.

Step 2: based on the default first luminance threshold, the default gamma value, and a default first electro-optical transfer function (EOTF), computing to obtain a grayscale value corresponding to the first luminance threshold, and defining the grayscale value as a grayscale threshold.

Specifically, in Step 2, the first EOTF is the standard gamma curve function of the default gamma value: $Lum=Lmax\times(G/255)^{gamma}$;

wherein G is 8-bit grayscale value, Lum is the luminance corresponding to the grayscale value, Lmax is the maximum luminance value of the RGBW LCD, gamma is the default gamma value.

Step 2 computes the grayscale threshold based on the standard gamma curve function of the default gamma value; specifically, in the above embodiment, the grayscale threshold is $255\times(100/1000)^{1/2.2}$, i.e., 90 grayscale.

Step 3: based on the maximum luminance value of the RGBW LCD, the grayscale threshold computed in Step 2, the default first EOTF, and a default second EOTF, generating a grayscale luminance lookup table for the RGBW LCD;

within the grayscale interval from 0 grayscale value to the grayscale threshold, the relation between grayscale and luminance in the grayscale luminance lookup table being corresponding to the first EOTF; within the grayscale interval from the grayscale threshold to 255 grayscale, the relation between grayscale and luminance in the grayscale luminance lookup table being corresponding to the second EOTF;

within the interval of the second luminance threshold and the maximum luminance value, the slope of the curve of the second EOTF being greater than the slope of the curve of the first EOTF.

Specifically, in Step 3, the first EOTF is the standard gamma curve function of the default gamma value: $Lum=Lmax\times(G/255)^{gamma}$.

The second EOTF is:

$$Lum = 4000\times\left\{\frac{\max\left[\left(\frac{grayx}{1024}\right)^{\frac{1}{m2}} - C_{1.0}\right]}{C_2 - C_3\times\left(\frac{grayx}{1024}\right)^{\frac{1}{m2}}}\right\}^{\frac{1}{m1}};$$

wherein grayx is a 10-bit grayscale value corresponding to the 8-bit grayscale value obtained by using a default grayscale value compression equation, m1=0.159, m2=78.844, C1=0.836, C2=18.85, C3=18.69;

the default grayscale value compression equation is:

$$grayx = \left[(G - Gt)\times\frac{\text{gray2} - \text{gray1}}{255 - Gt}\right] + \text{gray}^1;$$

wherein Gt is the grayscale threshold computed in Step 2, gray1 is a 10-bit grayscale value corresponding to the first luminance threshold computed according to the default first luminance threshold and default 10-bit luminance grayscale transfer equation, gray2 is a 10-bit grayscale value corresponding to the maximum luminance value computed according to the maximum luminance value and the default 10-bit luminance grayscale transfer equation, grayx ranges from gray1 to gray2;

the default 10-bit luminance grayscale transfer equation is:

$$L = 4000\times\left\{\frac{\max\left[\left(\frac{grayx}{1024}\right)^{\frac{1}{m2}} - C_{1.0}\right]}{C_2 - C_3\times\left(\frac{grayx}{1024}\right)^{\frac{1}{m2}}}\right\}^{\frac{1}{m1}};$$

wherein L is a luminance value, gray is a 10-bit grayscale value corresponding to the luminance value.

Specifically, the 8-bit grayscale ranges from 0 to 255, and the 10-bt grayscale ranges from 0 to 1023.

Figure 1:
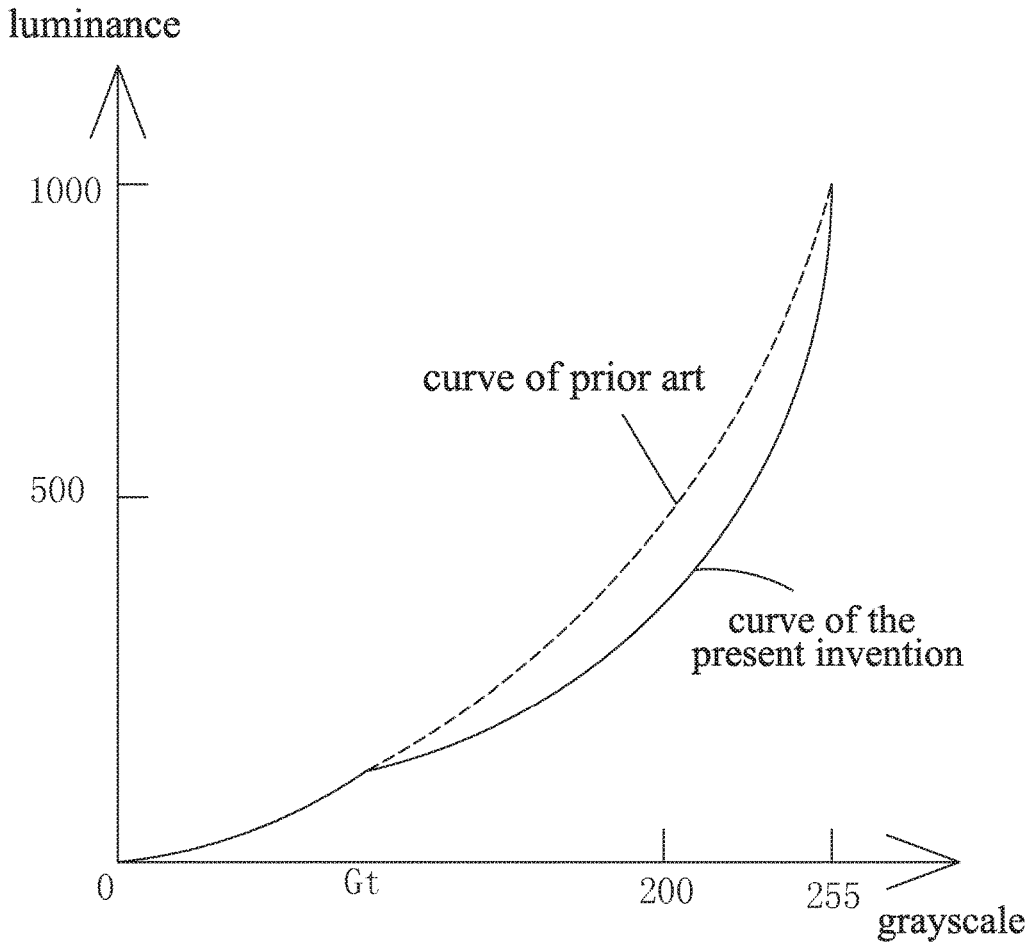
FIG. 1 is a schematic view showing the comparison of the relation between the grayscale and luminance for the luminance adjustment method for the RGBW LCD according to the present invention and the relation between the grayscale and luminance for the known LCD.

It should be noted that, as shown in FIG. 1, the dotted line in FIG. 1 and the solid line portion of 0 grayscale to Gt grayscale together form a curve of the first EOTF, and the solid line of Gt grayscale to 255 grayscale is the second EOTF. As shown in FIG. 1, the present invention improves the curve slope of the grayscale luminance curve of the RGBW LCD in the high luminance interval (i.e., the interval from the second luminance threshold to the maximum luminance threshold) by replacing the original dotted line portion of the curve of the first EOTF with the curve of the second EOTF, so that the luminance difference is larger in the high luminance interval for the same grayscale difference, which satisfies the recognition capability of human eye on the high luminance images to approximate to HDR display effect. At the same time, by keeping the original gamma curve for the interval between 0 grayscale and grayscale threshold, the present invention also consider the poor dark state characteristics for the LCD.

Preferably, in Step 3, an interpolation method is used to generate the grayscale luminance lookup table for RGBW LCD. The interpolation method makes all the grayscale values in the grayscale luminance lookup table integers.

Step 4: based on the grayscale luminance lookup table generated in Step 3, adjusting the luminance of the RGBW LCD.

Figure 2:
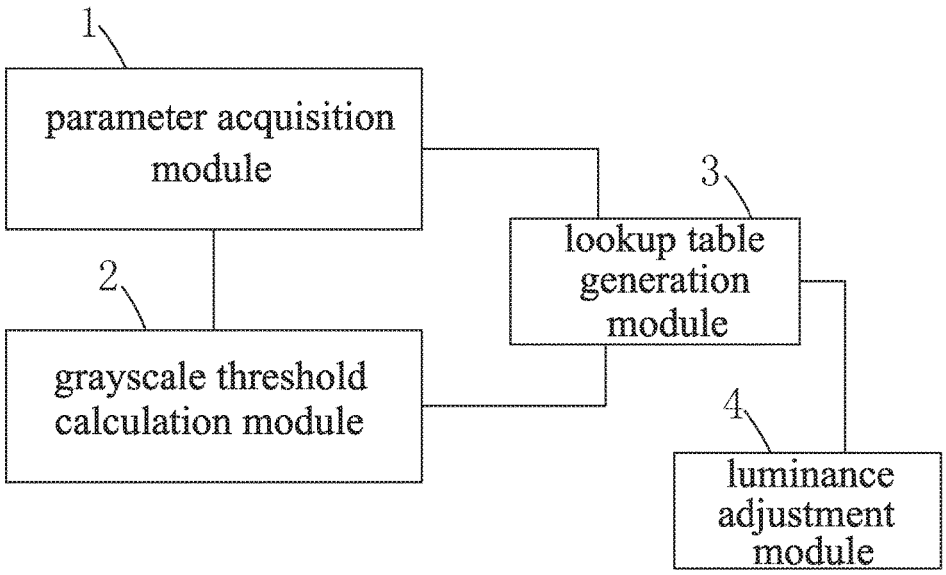
FIG. 2 is a schematic view showing the modules of the luminance adjustment apparatus for RGBW LCD according to the present invention.

Refer to FIG. 2, a luminance adjustment apparatus for RGBW LCD, comprising: a parameter acquisition module 1, a grayscale threshold calculation module 2 related to the parameter acquisition module 1, a lookup table generation module 3 related to the parameter acquisition module 1 and the grayscale threshold calculation module 2, and a luminance adjustment module 4 related to the lookup table generation module 3;

the parameter acquisition module 1 is for acquiring the maximum luminance value, a default first luminance threshold, a default second luminance threshold, and a default gamma value of the RGB LCD, the default second luminance threshold being greater than the default first luminance threshold;

the grayscale threshold calculation module 2 is for, based on the default first luminance threshold, the default gamma value, and a default first electro-optical transfer function (EOTF), computing to obtain a grayscale value corresponding to the first luminance threshold, and defining the grayscale value as a grayscale threshold;

the lookup table generation module 3 is for, based on the maximum luminance value of the RGBW LCD, the grayscale threshold, the default first EOTF, and a default second EOTF, generating a grayscale luminance lookup table for the RGBW LCD; within the grayscale interval from 0 grayscale value to the grayscale threshold, the relation between grayscale and luminance in the grayscale luminance lookup table being corresponding to the first EOTF; within the grayscale interval from the grayscale threshold to 255 grayscale, the relation between grayscale and luminance in the grayscale luminance lookup table being corresponding to the second EOTF;

within the interval of the second luminance threshold and the maximum luminance value, the slope of the curve of the second EOTF being greater than the slope of the curve of the first EOTF;

the luminance adjustment module 4 is for, based on the grayscale luminance lookup table generated by the lookup table generation module, adjusting the luminance of the RGBW LCD.

Specifically, the default gamma value ranges from 1.8 to 2.4. The first luminance threshold and the second luminance threshold can be selected by considering both the maximum luminance value and actual application. The RGBW LCD uses 8-bit grayscale values, i.e., from 0 grayscale to 255 grayscale.

For example, in an embodiment of the present invention, the maximum luminance value for the provided RGBW LCD is 1000 nits, the default first luminance threshold is 100 nits, the default second luminance threshold is 700 nits, and the default gamma value is 2.2.

Specifically, the first EOTF is the standard gamma curve function of the default gamma value: $Lum=Lmax\times(G/255)^{gamma}$;

wherein G is 8-bit grayscale value, Lum is the luminance corresponding to the grayscale value, Lmax is the maximum luminance value of the RGBW LCD, gamma is the default gamma value.

The second EOTF is:

$$Lum = 4000\times\left\{\frac{\max\left[\left(\frac{grayx}{1024}\right)^{\frac{1}{m2}} - C_{1.0}\right]}{C_2 - C_3\times\left(\frac{grayx}{1024}\right)^{\frac{1}{m2}}}\right\}^{\frac{1}{m1}};$$

wherein grayx is a 10-bit grayscale value corresponding to the 8-bit grayscale value obtained by using a default grayscale value compression equation, m1=0.159, m2=78.844, C1=0.836, C2=18.85, C3=18.69;

the default grayscale value compression equation is:

$$grayx = \left[(G - Gt)\times\frac{\text{gray2} - \text{gray1}}{255 - Gt}\right] + \text{gray}^1;$$

wherein Gt is the grayscale threshold, gray1 is a 10-bit grayscale value corresponding to the first luminance threshold computed according to the default first luminance threshold and default 10-bit luminance grayscale transfer equation, gray2 is a 10-bit grayscale value corresponding to the maximum luminance value computed according to the maximum luminance value and the default 10-bit luminance grayscale transfer equation, grayx ranges from gray1 to gray2;

the default 10-bit luminance grayscale transfer equation is:

$$L = 4000\times\left\{\frac{\max\left[\left(\frac{grayx}{1024}\right)^{\frac{1}{m2}} - C_{1.0}\right]}{C_2 - C_3\times\left(\frac{grayx}{1024}\right)^{\frac{1}{m2}}}\right\}^{\frac{1}{m1}};$$

wherein L is a luminance value, gray is a 10-bit grayscale value corresponding to the luminance value.

It should be noted that, as shown in FIG. 1, the dotted line in FIG. 1 and the solid line portion of 0 grayscale to Gt grayscale together form a curve of the first EOTF, and the solid line of Gt grayscale to 255 grayscale is the second EOTF. As shown in FIG. 1, the present invention improves the curve slope of the grayscale luminance curve of the RGBW LCD in the high luminance interval (i.e., the interval from the second luminance threshold to the maximum luminance threshold) by replacing the original dotted line portion of the curve of the first EOTF with the curve of the second EOTF, so that the luminance difference is larger in the high luminance interval for the same grayscale difference, which satisfies the recognition capability of human eye on the high luminance images to approximate to HDR display effect. At the same time, by keeping the original gamma curve for the interval between 0 grayscale and grayscale threshold, the present invention also consider the poor dark state characteristics for the LCD.

Preferably, an interpolation method is used to generate the grayscale luminance lookup table for RGBW LCD. The interpolation method makes all the grayscale values in the grayscale luminance lookup table integers.

In summary, the present invention provides a luminance adjustment method and apparatus for RGBW LCD, by using different EOTFs for low luminance interval and high luminance interval, is able to take into account the poor dark state characteristics of the LCD and the characteristics of the RGBW LCD having higher maximum luminance value, to improve the display capability of the RGBW LCD in details of high grayscale images.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A luminance adjustment method for RGBW liquid crystal display (LCD), comprising the following steps of:

Step 1: providing a RGBW LCD, obtaining the maximum luminance value, a default first luminance threshold, a default second luminance threshold, and a default gamma value of the RGBW LCD, the default second luminance threshold being greater than the default first luminance threshold;

Step 2: based on the default first luminance threshold, the default gamma value, and a default first electro-optical transfer function (EOTF), computing to obtain a grayscale value corresponding to the first luminance threshold, and defining the grayscale value as a grayscale threshold;

Step 3: based on the maximum luminance value of the RGBW LCD, the grayscale threshold computed in Step 2, the default first EOTF, and a default second EOTF, generating a grayscale luminance lookup table for the RGBW LCD;

within the grayscale interval from 0 grayscale value to the grayscale threshold, the relation between grayscale and luminance in the grayscale luminance lookup table being corresponding to the first EOTF; within the grayscale interval from the grayscale threshold to 255 grayscale, the relation between grayscale and luminance in the grayscale luminance lookup table being corresponding to the second EOTF;

within the interval of the second luminance threshold and the maximum luminance value, the slope of the curve of the second EOTF being greater than the slope of the curve of the first EOTF;

Step 4: based on the grayscale luminance lookup table generated in Step 3, adjusting the luminance of the RGBW LCD.

2. The luminance adjustment method for RGBW LCD as claimed in claim 1, wherein the first EOTF is the standard gamma curve function of the default gamma value:

$$\mathrm{Lum}=L\max\times(G/255)^{gamma},$$

wherein G is 8-bit grayscale value, Lum is the luminance corresponding to the grayscale value, Lmax is the maximum luminance value of the RGBW LCD, gamma is the default gamma value.

3. The luminance adjustment method for RGBW LCD as claimed in claim 1, wherein the second EOTF is:

$$Lum = 4000\times\left\{\frac{\max\left[\left(\frac{grayx}{1024}\right)^{\frac{1}{m2}}-C_{1.0}\right]}{C_2-C_3\times\left(\frac{grayx}{1024}\right)^{\frac{1}{m2}}}\right\}^{\frac{1}{m1}};$$

wherein grayx is a 10-bit grayscale value corresponding to the 8-bit grayscale value obtained by using a default grayscale value compression equation, m1=0.159, m2=78.844, C1=0.836, C2=18.85, C3=18.69;

the default grayscale value compression equation is:

$$grayx=\left[(G-Gt)\times\frac{\mathrm{gray2}-\mathrm{gray1}}{255-Gt}\right]+\mathrm{gray1};$$

wherein Gt is the grayscale threshold computed in Step 2, gray1 is a 10-bit grayscale value corresponding to the first luminance threshold computed according to the default first luminance threshold and default 10-bit luminance grayscale transfer equation, gray2 is a 10-bit grayscale value corresponding to the maximum luminance value computed according to the maximum luminance value and the default 10-bit luminance grayscale transfer equation, grayx ranges from gray1 to gray2;

the default 10-bit luminance grayscale transfer equation is:

$$L = 4000\times\left\{\frac{\max\left[\left(\frac{grayx}{1024}\right)^{\frac{1}{m2}}-C_{1.0}\right]}{C_2-C_3\times\left(\frac{grayx}{1024}\right)^{\frac{1}{m2}}}\right\}^{\frac{1}{m1}};$$

wherein L is a luminance value, gray is a 10-bit grayscale value corresponding to the luminance value.

4. The luminance adjustment method for RGBW LCD as claimed in claim 1, wherein the default gamma value ranges from 1.8 to 2.4.

5. The luminance adjustment method for RGBW LCD as claimed in claim 1, wherein in Step 3, an interpolation method is used to generate the grayscale luminance lookup table for RGBW LCD.

6. A luminance adjustment apparatus for RGBW liquid crystal display (LCD), comprising: a parameter acquisition module, a grayscale threshold calculation module related to the parameter acquisition module, a lookup table generation module related to the parameter acquisition module and the grayscale threshold calculation module, and a luminance adjustment module related to the lookup table generation module;

the parameter acquisition module being for acquiring the maximum luminance value, a default first luminance threshold, a default second luminance threshold, and a default gamma value of the RGB LCD, the default second luminance threshold being greater than the default first luminance threshold;

the grayscale threshold calculation module being for, based on the default first luminance threshold, the default gamma value, and a default first electro-optical transfer function (EOTF), computing to obtain a grayscale value corresponding to the first luminance threshold, and defining the grayscale value as a grayscale threshold;

the lookup table generation module being for, based on the maximum luminance value of the RGBW LCD, the grayscale threshold, the default first EOTF, and a default second EOTF, generating a grayscale luminance lookup table for the RGBW LCD; within the grayscale interval from 0 grayscale value to the grayscale threshold, the relation between grayscale and luminance in the grayscale luminance lookup table being corresponding to the first EOTF; within the grayscale interval from the grayscale threshold to 255 grayscale, the relation between grayscale and luminance in the grayscale luminance lookup table being corresponding to the second EOTF;

within the interval of the second luminance threshold and the maximum luminance value, the slope of the curve of the second EOTF being greater than the slope of the curve of the first EOTF;

the luminance adjustment module being for, based on the grayscale luminance lookup table generated by the lookup table generation module, adjusting the luminance of the RGBW LCD.

7. The luminance adjustment apparatus for RGBW LCD as claimed in claim 6, wherein the first EOTF is the standard gamma curve function of the default gamma value:

$$\mathrm{Lum}=L\max\times(G/255)^{gamma},$$

wherein G is 8-bit grayscale value, Lum is the luminance corresponding to the grayscale value, Lmax is the maximum luminance value of the RGBW LCD, gamma is the default gamma value.

8. The luminance adjustment apparatus for RGBW as claimed in claim 6, wherein the second EOTF is:

$$Lum = 4000\times\left\{\frac{\max\left[\left(\frac{grayx}{1024}\right)^{\frac{1}{m2}}-C_{1.0}\right]}{C_2-C_3\times\left(\frac{grayx}{1024}\right)^{\frac{1}{m2}}}\right\}^{\frac{1}{m1}};$$

wherein grayx is a 10-bit grayscale value corresponding to the 8-bit grayscale value obtained by using a default grayscale value compression equation, m1=0.159, m2=78.844, C1=0.836, C2=18.85, C3=18.69;

the default grayscale value compression equation is:

$$grayx = \left[(G - Gt) \times \frac{\text{gray2} - \text{gray1}}{255 - Gt}\right] + \text{gray}^1;$$

wherein Gt is the grayscale threshold computed in Step 2, gray1 is a 10-bit grayscale value corresponding to the first luminance threshold computed according to the default first luminance threshold and default 10-bit luminance grayscale transfer equation, gray2 is a 10-bit grayscale value corresponding to the maximum luminance value computed according to the maximum luminance value and the default 10-bit luminance grayscale transfer equation, grayx ranges from gray1 to gray2;

the default 10-bit luminance grayscale transfer equation is:

$$L = 4000 \times \left\{\frac{\max\left[\left(\frac{grayx}{1024}\right)^{\frac{1}{m2}} - C_{1.0}\right]}{C_2 - C_3 \times \left(\frac{grayx}{1024}\right)^{\frac{1}{m2}}}\right\}^{\frac{1}{m1}};$$

wherein L is a luminance value, gray is a 10-bit grayscale value corresponding to the luminance value.

9. The luminance adjustment apparatus for RGBW LCD as claimed in claim 6, wherein the default gamma value ranges from 1.8 to 2.4.

10. The luminance adjustment apparatus for RGBW LCD as claimed in claim 6, wherein the lookup table generation module uses an interpolation method to generate the grayscale luminance lookup table for RGBW LCD.

11. A luminance adjustment method for RGBW liquid crystal display (LCD), comprising the following steps of:

Step 1: providing a RGBW LCD, obtaining the maximum luminance value, a default first luminance threshold, a default second luminance threshold, and a default gamma value, the default second luminance threshold being greater than the default first luminance threshold;

Step 2: based on the default first luminance threshold, the default gamma value, and a default first electro-optical transfer function (EOTF), computing to obtain a grayscale value corresponding to the first luminance threshold, and defining the grayscale value as a grayscale threshold;

Step 3: based on the maximum luminance value of the RGBW LCD, the grayscale threshold computed in Step 2, the default first EOTF, and a default second EOTF, generating a grayscale luminance lookup table for the RGBW LCD;

within the grayscale interval from 0 grayscale value to the grayscale threshold, the relation between grayscale and luminance in the grayscale luminance lookup table being corresponding to the first EOTF; within the grayscale interval from the grayscale threshold to 255 grayscale, the relation between grayscale and luminance in the grayscale luminance lookup table being corresponding to the second EOTF;

within the interval of the second luminance threshold and the maximum luminance value, the slope of the curve of the second EOTF being greater than the slope of the curve of the first EOTF;

Step 4: based on the grayscale luminance lookup table generated in Step 3, adjusting the luminance of the RGBW LCD;

wherein the default gamma value ranging from 1.8 to 2.4;

wherein in Step 3, an interpolation method being used to generate the grayscale luminance lookup table for RGBW LCD.

12. The luminance adjustment method for RGBW LCD as claimed in claim 11, wherein the first EOTF is the standard gamma curve function of the default gamma value:

$$\text{Lum} = Lmax \times (G/255)^{gamma},$$

wherein G is 8-bit grayscale value, Lum is the luminance corresponding to the grayscale value, Lmax is the maximum luminance value of the RGBW LCD, gamma is the default gamma value.

13. The luminance adjustment method for RGBW LCD as claimed in claim 11, wherein the second EOTF is:

$$Lum = 4000 \times \left\{\frac{\max\left[\left(\frac{grayx}{1024}\right)^{\frac{1}{m2}} - C_{1.0}\right]}{C_2 - C_3 \times \left(\frac{grayx}{1024}\right)^{\frac{1}{m2}}}\right\}^{\frac{1}{m1}};$$

wherein grayx is a 10-bit grayscale value corresponding to the 8-bit grayscale value obtained by using a default grayscale value compression equation, m1=0.159, m2=78.844, C1=0.836, C2=18.85, C3=18.69;

the default grayscale value compression equation is:

$$grayx = \left[(G - Gt) \times \frac{\text{gray2} - \text{gray1}}{255 - Gt}\right] + \text{gray}^1;$$

wherein Gt is the grayscale threshold computed in Step 2, gray1 is a 10-bit grayscale value corresponding to the first luminance threshold computed according to the default first luminance threshold and default 10-bit luminance grayscale transfer equation, gray2 is a 10-bit grayscale value corresponding to the maximum luminance value computed according to the maximum luminance value and the default 10-bit luminance grayscale transfer equation, grayx ranges from gray1 to gray2;

the default 10-bit luminance grayscale transfer equation is:

$$L = 4000 \times \left\{\frac{\max\left[\left(\frac{grayx}{1024}\right)^{\frac{1}{m2}} - C_{1.0}\right]}{C_2 - C_3 \times \left(\frac{grayx}{1024}\right)^{\frac{1}{m2}}}\right\}^{\frac{1}{m1}};$$

wherein L is a luminance value, gray is a 10-bit grayscale value corresponding to the luminance value.

* * * * *